United States Patent [19]

Stromquist et al.

[11] Patent Number: 4,693,765

[45] Date of Patent: Sep. 15, 1987

[54] GEL TYPE SLURRY EXPLOSIVE AND MATRIX AND METHOD FOR MAKING SAME

[76] Inventors: Donald M. Stromquist, Thirty-three C St., Salt Lake City, Utah 84103; Boyd J. Wathen, 135 W. 740 North, American Fork, Utah 84003

[21] Appl. No.: 866,455

[22] Filed: May 22, 1986

[51] Int. Cl.[4] ..... C06B 36/30

[52] U.S. Cl. ..... 149/60; 149/2; 149/46; 149/61; 149/70; 149/76; 149/85; 149/109.6

[58] Field of Search ..... 149/2, 46, 60, 61, 70, 149/76, 85, 109.6

[56] References Cited

U.S. PATENT DOCUMENTS

| | | | |
|---|---|---|---|
| Re. 26,804 | 2/1970 | Clay et al. | 149/38 |
| 3,180,768 | 4/1965 | Scott, Jr. | 149/2 |
| 3,190,777 | 6/1965 | Breza et al. | 149/57 |
| 3,282,753 | 11/1966 | Cook et al. | 149/46 |
| 3,390,029 | 6/1968 | Preckel | 149/41 |
| 3,574,011 | 4/1971 | Knight, Jr. | 149/70 |
| 3,617,402 | 11/1971 | Knight, Jr. | 149/2 |
| 3,765,967 | 10/1973 | Funk et al. | 149/21 |
| 3,899,374 | 8/1975 | Sylkhouse | 149/21 |
| 3,925,123 | 12/1975 | Jessop | 149/60 |
| 4,104,092 | 8/1978 | Mullay | 149/2 |
| 4,110,134 | 8/1978 | Wade | 149/2 |
| 4,111,727 | 9/1978 | Clay | 149/2 |
| 4,149,916 | 4/1979 | Wade | 149/56 |
| 4,181,546 | 1/1980 | Clay | 149/21 |
| 4,221,618 | 9/1980 | Cook | 149/21 |
| 4,439,254 | 3/1984 | Mullay | 149/2 |
| 4,453,989 | 6/1984 | Mullay | 149/21 |
| 4,474,628 | 10/1984 | Sudweeks et al. | 149/21 |

*Primary Examiner*—Stephen J. Lechert, Jr.
*Attorney, Agent, or Firm*—Mallinckrodt & Mallinckrodt

[57] ABSTRACT

A matrix material to be added to a standard ammonium nitrate-fuel oil dry explosive to form an economical slurry explosive having excellent water resistant properties includes an oxidizer solution chosen from the group of an aqueous sodium perchlorate solution, an aqueous ammonium perchlorate solution, an aqueous calcium nitrate solution, or a combination thereof, along with a fuel such as ethylene glycol or fuel oil and a thickening agent such as a guar gum in combination with an acid such as glacial acetic acid. The oxidizer solution generally makes up about 94%–97% by weight of the matrix. The slurry explosive is made by mixing the matrix with a standard ammonium nitrate-fuel oil dry explosive and then adding a cross linker to the mixture so that it forms a gel. The matrix may make up between about 14% to 40% by weight of the explosive, and preferably makes up about 20% by weight.

24 Claims, No Drawings

GEL TYPE SLURRY EXPLOSIVE AND MATRIX AND METHOD FOR MAKING SAME

BACKGROUND OF THE INVENTION

1. Field

The invention is in the field of ammonium nitrate-fuel oil based slurry explosives.

2. State of the Art

Explosives are an important part of the mining industry and it is estimated that over three billion pounds of explosives are used each year in that industry in the United States alone. The most commonly used basic explosive is a mixture of ammonium nitrate and fuel oil commonly referred to as ANFO. This generally comprises 94% ammonium nitrate mixed with 6% No. 2 fuel oil. It is a dry explosive and is generally marketed in bags or in bulk. It is not water resistant so cannot be used in damp or water immersed environments.

Over the years many attempts have been made to increase the explosive power of a given amount of ANFO, to make it water resistant so that it can be used in damp and water immersed environments such as in blast holes containing water, and to make it easier to handle and load into bore holes for blasting. A common way of increasing the explosive strength of the ANFO is by the addition of a metal powder such as aluminum powder. A way of making the explosive easier to handle in the filling of bore holes is to make the explosive in the form of a flowable slurry, and slurry explosives have become very popular. By thickening the slurry in various ways, a slurry can be made to have varying degrees of water resistance.

The term strength of an explosive refers to the energy content of the explosive, which in turn, is a measure of force or power it can develop and its ability to do work. The term strength is used with ammonium nitrate based explosives to compare their energies to ANFO and is measured in kilo-calories per gram. In the case of ANFO, which is the base of reference, the value of weight strength is 1.0 k-cal/gm. The other term, bulk strength, compares explosives on a bulk or volume basis, and is a function of the density of the material. The higher the density, the higher the bulk strength. Its unit of measure is kilo-calories per cubic centimeter, abbreviated k-cal/cc.

The most common form of slurry explosives are emulsions which are mixed with ANFO. The emulsions are oil in water or water in oil emulsions which contain oxidizers and fuels in various proportions and are mixed with ANFO wherein the emulsion generally makes up 30% to 50% of the final mixture. Emulsion explosives generally have less weight strength then ANFO, but usually have increased density.

The performance of emulsion-ANFO products is erratic. Not all are water-resistant and the shelf life of bagged material is notoriously poor. Emulsions are basically unstable and tend to separate. Many mines and quarries have experienced shot failures. The density of the final emulsion-ANFO product is not what one would call a natural density but is often controlled by the addition of perlite or glass microspheres. These things are inert materials and in an explosive reaction, do not add to the energy, but subtract from it.

Another class of slurry explosive is known as water gels. These are combinations of various oxidizers, fuels and other chemicals, including water, with the major constituent being ammonium nitrate. Water gels are marketed in bags or in bulk and are water resistant. Water gels can be cross-linked, i.e., can be made more viscous, water resistant or self-supporting by chemical addition.

Conventional water gels are complicated and costly to make. A well known example is Thermex's T-600. About one half of the ingredients are made into a mother liquor and this requires substantial heating. The rest of the dry ingredients are then blended with the mother liquor in a ribbon mixer or a large concrete mixer. The ingredients are water, ammonium nitrate, hexamine, nitric acid, ammonium perchlorate, gilsonite and sodium nitrate. The materials used are expensive compared to ANFO as is the plant equipment to make the water gel, and such gels are not made on site.

There remains a need for an inexpensive, easily made slurry explosive having increased explosive strength over ANFO and which is highly water resistant.

SUMMARY OF THE INVENTION

According to the invention, an economical slurry explosive having good water resistant properties, and generally increased explosive strength over ANFO is easily made by a matrix material with ANFO wherein the matrix material makes up only between about 14% to about 40% of the mixture. The mixture forms a water gel and may be cross-linked to increase water resistance.

The matrix material includes an oxidizer solution which also acts as a sensitizer and is selected from the group consisting of an aqueous sodium perchlorate solution, an aqueous calcium nitrate solution, an aqueous ammonium perchlorate solution, or a combination of such solutions, a liquid fuel such as ethylene glycol or fuel oil, and a thickening agent such as a guar gum in combination with an acid, such as glacial acetic acid, which also acts to adjust the pHh of matrix. The sodium perchlorate solution is preferably a 55% by weight aqueous solution and may comprise up to about 97% of the matrix. Since the sodium perchlorate solution makesup the bulk of the matrix and is relatively expensive, the cost of the matrix may be reduced, along with some of the increased explosive strength, while maintaining the desireable slurry and water resistant properties of the finished explosive, by substituting a calcium nitrate solution for all or part of the sodium perchlorate solution. The calcium nitrate solution is preferably about a 50% aqueous solutio. The matrix takes the form of viscous, honey-like material. The ammonium perchlorate solution currently is much more expensive then the sodium perchlorate solution so is currently not preferred for use in the invention, but if used would be aqueous solution similar to the sodium perchlorate solution.

The matrix and ANFO may be mixed and cross-linked at a central site and the resulting explosive bagged for transport and use, or the matrix and ANFO may be mixed on site using conventional mixing equipment, and, with or without cross-linking, be pumped into the desired location for later detonation.

The slurry explosive of the invention is not cap sensitive and requires a minimum one third pound cast primer or dynamite to set it off. The sensitivity of the explosive depends upon the amount of sodium perchlorate used in the matrix with maximum sodium perchlorate use producing an explosive that will explode satisfactorily in charge diameters of down to two inches while if maximum calcium nitrate is used, charge diameters of at least five inches are needed for satisfactory detonation.

DETAILED DESCRIPTION OF PREFFERED EMBODIMENTS

The slurry explosive of the invention is made up of a matrix material which is mixed with ANFO and with a cross-linker to produce the final explosive.

In a first embodiment of the invention, the matrix has the following formula:

| | |
|---|---|
| 55% $NaClO_4$–45% $H_2O$ | 96.6% |
| Ethylene Glycol | 2.0% |
| HP-8 Guar Gum | 1.3% |
| Glacial Acetic Acid | 0.10% |

The matrix produced by the above formulation is thick and honey-like and is much more viscous than emulsions used to mix with ANFO for emulsion type slurry explosives. A matrix made according to the above formula was found in testing to have a viscosity of 1,930,000 centipoises. The matrix was also found to be thixotropic, which means that the apparent viscosity becomes lower as the shear rate on the material increases. The viscosity measured was using a low shear rate generated at 0.3 rpm using a number 4 spindle in the Brookfield viscosity test.

The ethylene glycol in the matrix is a fuel material which provides additional fuel to balance the oxidation reaction which would otherwise be unbalanced during detonation of the explosive because of the additional oxidizers in the matrix. The guar gum is added as a thickening agent and works in conjunction with the acid to thicken the matrix. It has been found that the guar gum alone will not appreciably thicken the matrix beyond a watery consistency, but that with the addition of the acid, the viscosity of the matrix is greatly increased. In addition, the acid controls the ph of the matrix and of the final slurry which controls the activity of the cross-linker to be added later. While any guar gum may be used, it has been found that HP-8 guar gum as manufactured by Celanese Corporation, Louisville, Ky., appears to give the most satisfactory results.

In the making of the matrix, the guar gum is mixed with the ethylene glycol to form a suspension. This suspension is then added to the sodium perchlorate solution, which is supplied commercially in the form of an aqueous solution, usually between 60% to 65% sodium perchlorate, by either Pacific Engineering or Kerr McGee, both in Henderson, Nev. The solution commercially supplied is diluted to 55% sodium perchlorate preferred for the matrix prior to mixing the matrix. The acid is added last to the matrix and the matrix then becomes viscous and honey-like.

The matrix is mixed with ANFO using the standard 94% ammonium nitrate to 6% No. 2 fuel oil and also with a cross linker so that the slurry composition, by weight, is:

| | |
|---|---|
| Ammonium Nitrate | 75.14% |
| Fuel Oil | 4.8% |
| Matrix | 20.0% |
| Cross-linker DW-3 | 0.06% |

In mixing the matrix with the ANFO, the ANFO prills may be whole or crushed, or a combination. Crushing of the ANFO prills increases the sensitivity of the finished explosive and it has been found that with crushed ANFO, the critical diameter of the resulting slurry explosive is about two inches.

The mixing of the matrix and ANFO may be done using standard ribbon blenders or rotary mixers. The matrix and ANFO is mixed first and the cross-linker is added thereafter, but while still in the ribbon blender or rotary mixer. If the slurry is to be bagged, the slurry is transfered to a bagging hopper and is loaded into bags or cartridges having diameters of at least two inches. If the matrix and ANFO is to be mixed on site, the standard ANFO auger mixer is used but is modified so that the ammonium nitrate and fuel oil is mixed, and then as the mixture proceeds through the augur, the matrix is added and further on down the auger, after the matrix and ANFO have been mixed to the desired degree, the cross-linker is added. After mixing on site, the material discharged from the auger is dumped or pumped to the desired location.

The matrix density is between about 1.3 and 1.4 gm/cc, usually between about 1.35 and 1.37 gm/cc, and when mixed 20% with ANFO which has a density of 0.82 gm/cc results in a final water gel slurry having a density of about 1.15 gm/cc. The density change is not a linear relationship because ANFO has 40% void space, and because some of the ANFO is dissolved in the matrix. The matrix enhances the performance of ANFO by filling the air voids with materials that contribute to the explosive reaction. In addition, the matrix itself contains chemicals that are more productive in energy than ANFO. The final density of the slurry is controlled by the mixing of the matrix with the ANFO which results in air entrainment. The presently desired density is between about 1.10 to about 1.15 gm/cc, but higher and lower densities can be used. The cross-linker causes the final slurry to take on a gel consistency and keeps the density of the slurry substantially constant over extended periods of time (shelf life), currently tested up to six months. Various cross-linkers, such as an aqueous solution of sodium bichromate, may be used but it is presently preferred when the slurry is to be packaged to use DW-3 cross-linker as made by Celanase Corporation, Louisville, Ky., because this results in a good shelf life for the final slurry product. DW-3 is a potassium pyroantimonate solution.

With the matrix formulation shown above, the explosive power of the finished slurry is increased from the 1.0 k-cal/gm weight strength of ANFO to about 1.16 to 1.20 k-cal/gm weight strength. This compares with a decrease in explosive power when emulsions are used to mix with ANFO.

In a second embodiment of the invention, the matrix has the following formula:

| | |
|---|---|
| Calcium Nitrate | 48.0% |
| $H_2O$ | 48.0% |
| Fuel Oil | 2.6% |
| HP-8 Guar Gum | 1.3% |
| Glacial Acetic Acid | 0.10% |

In making this matrix, the calcium nitrate, which is commercially available as a solid, is added to the water and substantially dissolved to give a 50% aqueous calcium nitrate solution. The gum is mixed with some or all of the fuel oil and the fuel oil and gum mixture is added to the calcium nitrate solution. The acid is then added and the matrix forms a thick honey like material.

In the second matrix, the sodium perchlorate solution as used in the first matrix is replaced with the calcium nitrate solution which is much less expensive. Further, the fuel material used is fuel oil rather than the more expensive ethylene glycol, although ethlene gycol could also be used.

This matrix is similarly mixed with ANFO and preferably a cross-linker to form the finished slurry explosive as follows:

| | |
|---|---|
| Ammonium Nitrate | 75.14% |
| Fuel Oil | 4.8% |
| Matrix | 20.0% |
| Cross-linker, DW-3 | 0.06% |

As with the first matrix embodiment, the matrix and ANFO is mixed, such as in a ribbon blender or rotary mixer, and then the cross-linker is added. The desired density of the slurry is about 1.15 g/cc.

The second matrix produces a less sensitive explosive with a critical diameter of about five inches. Thus, the bags or cartridges into which the explosive is loaded must have diameters at least five inches. Also, the slurry has less explosive strength than that made with the first matrix, and in terms of weight strength, is less than the weight strength for ANFO. However, because of its density, its bulk strength is just slightly higher than that of ANFO and because it is a gel, it exhibits excellent water resistant properties. The cost of the explosives made according to the above formula is less than the cost of ANFO.

The two matrices specifically described above represent two approximate ends of the range of matrices of the invention. The first matrix containing over 96% sodium perchlorate solution and the second containing no sodium perchlorate solution and about 96% calcium nitrate solution. The material costs for first matrix run several times again as much as the material costs for the second matrix. A matrix with composition anywhere between the two matrixes given may be made by merely varying the proportion of sodium perchlorate solution to clacium nitrate solution. Such variation will vary the cost of materials, the sensitivity, and the explosive power of the finished slurry.

In a third embodiment of the invention, the matrix has the following formula which combines the sodium perchlorate solution and the calcium nitrate solution:

| | |
|---|---|
| 55% Na $Clo_4$–45% $H_2O$ solution | 10.0% |
| Calcium Nitrate | 42.3% |
| $H_2O$ | 43.7% |
| Fuel Oil | 2.5% |
| HP-8 Guar Gum | 1.3% |
| Glacial Acetic Acid | 0.1% |

In making this matrix, the calcium nitrate is added to the water and substantially dissolved to give an aqueous calcium nitrate solution. The sodium perchlorate solution is added to the calcium nitrate solution. The gum is mixed with some or all of the fuel oil and the fuel oil and gum suspension is added to the calcium nitrate-sodium perchlorate solution. The acid is added last.

Again, the matrix is a thick and honey like material and the matrix of the above formulation has been found to have a viscosity of 530,000 centipoises when measured in a Brookfield viscosity test using 0.3 rpm and a number 4 spindle. This matrix was also found to be thixotropic.

The matrix is mixed with ANFO and a cross-linker using the same formula as for the prior two examples to produce the final slurry, again with a desired density of about 1.15 g/cc.

This third matrix formulation produces an explosive with about the same sensitivity as the second embodiment with a critical diameter of about five inches, but produces an explosive having significantly increased weight strength over the second embodiment, i.e. a weight strength of about 1.1 k cal/gm, which is just over that of ANFO. Because of its density, however, its bulk strength is significantly higher than that of ANFO, and the cost is just slightly more than the cost of ANFO.

In a fourth embodiment of the invention, the matrix has the following formula:

| | |
|---|---|
| 55% Na $ClO_4$–45% $H_2O$ solution | 80% |
| Calcium Nitrate | 7.3% |
| $H_2O$ | 7.3% |
| Ethylene Glycol | 4.0% |
| HP-8 Guar Gum | 1.3% |
| Glacial Acetic Acid | 0.10% |

The matrix is again mixed with ANFO using the same formula as for the first two embodiments, and gives an explosive which is very close in explosive power to the first embodiment using no calcium nitrate, but is about 8% less in cost.

It will be noted that the fuel used in this fourth embodiment of the matrix is ethylene glycol, as in the first embodiment, rather than fuel oil as in the second and third embodiments. It has been found that with significant amounts of sodium perclorate in the matrix, fuel oil cannot be used as the fuel because when the suspension of the fuel oil and gum is added to the sodium perchlorate solution, a reaction takes place which blocks the satisfactory creation of the matrix.

The mixing of the matrix first and then adding the matrix to the ANFO has been found necessary because if all ingredients are mixed together at once, the resulting slurry is too stiff and does not flow. It should be noted that the matrix is made without any heat added during mixing and that the slurry resulting from mixing the matrix and the ANFO is also made with no heat added.

The shelf life of the slurry explosive of the invention has been tested up to six months and may be longer. In addition, there has been no apparent crystal growth in the product held under ambient conditions for up to the six months. This is important because crystal growth is one of the things that seriously impairs explosive performance.

The cross-linking rate in the final slurry is controlled by controlling the pH of the mixture and can be varied by varying the acid in the matrix, or by varying acid in the final mixture. A pH of between 4 and 5 is generally satisfactory. Above that range, it is difficult to get satisfactory cross-linking. Below that range cross linking proceeds to rapidly and does not hold up, but breaks down in the finished product giving a very short shelf life. The cross-linking rate is also controlled by the temperature at which the cross-linking takes place. The formulas given above apply when matrix, ANFO and ambient temperatures are all in the range between about 40° and 80° Fahrenheit. If the ingredients are to be mixed at other temperatures the pH should be further adjusted to compensate for the temperature effect. Thus, at higher temperature, where the temperature increases the cross-linking activity, a higher pH is desireable, while at lower temperatures, a lower pH is desireable.

While emulsion concentrates are subject to freezing at the freezing temperature of water, the matrix of the invention remains fluid, pumpable, and mixable at below zero degrees Fahrenheit. The slurry also remains fluid and pumpable at much lower temperatures than emulsion mixtures.

While both examples of mixing the matrix with ANFO to produce a slurry show a 20% matrix content, this may be varied to some degree and may go as low as about 14% matrix. Below about 14% matrix, the resulting explosive becomes quite dry and does not flow easily. Also, when the mixture becomes dry, much of the water resistance of the product is lost. In addition, below about 14% matrix, the oxygen balance changes, the density is decreased, and therefore the power is decreased.

It has been found that the explosive will work effectively with up to about 40% matrix content, but the results are not noticeably better than at the 20% and the cost of the finished product increases as the amount of matrix used increases so there generally will be no reason to go over about 20% matrix.

All of the embodiments of the invention have been found to be very effective in water resistant properties, and this water resistance is a principal advantage the current invention has over the standard dry ANFO explosive. Water resistance relates to the explosives ability to detonate under conditions of wetness or immersion in water.

The cross-linked explosive made with the third matrix embodiment described was tested for water resistance by placing bags of the explosive, with sides of the bags slit so water could enter the bags in a water tank with thirty psi water pressure for eight hours. This was the equivalent of having the explosive in a hole under 69.3 feet of water. After the eight hours immersed in the water, the explosive was removed and detonated with a one pound cast primer. The slurry explosive, in an unconfined state, completely detonated. Slurry explosives made using the other matrixes described exhibit similar water resistant characteristics as indicated by tests in water filled blast holes. In order for emulsion-ANFO mixtures to exhibit similar water resistant properties, the emulsion must generally make up 45–50% of the slurry.

The slurry explosive of the invention is not cap sensitive, but requires a large charge to cause detonation. Cast primers or dynamite are usually required and while in most cases the explosive can be detonated by a one-third pound cast primer, it is preferred that one pound cast primers be used.

With the same matrix formulation of the invention, and same slurry composition, the slurry may be used either in bulk or may be packaged. With bulk use, the slurry may be mixed on site, or may be mixed except for the cross-linker, loaded into a bulk truck, and the cross-linker added as the slurry is dispensed from the truck on site.

While the examples show a sodium perchlorate solution containing 55% by weight sodium perchlorate and a calcium nitrate solution containing about 50% by weight calcium nitrate, the concentrations of these solutions is not critical and may vary to some extent. Further, while the oxidizer solution will generally make up between about 94% to 97% of the matrix, this amount may also be varied to some extent.

Whereas this invention is here described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A non-explosive matrix composition to be added to an ammonium nitrate-fuel oil explosive mixture to form a slurry explosive, comprising an oxidizer solution selected from the group consisting of an aqueous sodium perchlorate solution, an aqueous ammonium perchlorate solution, an aqueous calcium nitrate solution, or a combination thereof; a thickening agent; and a fuel which serves as a dispersing agent for the thickening agent, the water and other ingredient content of the matrix being such as will make the matrix effective, when mixed with standard ammonium nitrate-fuel oil dry explosive in the range of about 14% to 40% matrix by weight, to produce a slurry explosive.

2. A matrix composition according to claim 1, wherein the thickening agent is a guar gum and an acid.

3. A matrix composition according to claim 2, wherein the acid is glacial acetic acid.

4. A matrix composition according to claim 1, wherein the sodium perchlorate solution contains about 55% by weight $NaClO_4$ and about 45% $H_2O$.

5. A matrix composition according to claim 1 wherein the calcium nitrate solution contains about 50% by weight calcium nitrate and about 50% $H_2O$.

6. A matrix composition according to claim 1, wherein the fuel is ethylene glycol.

7. A matrix composition according to claim 1, wherein the fuel is fuel oil.

8. A matrix composition according to claim 1, wherein the oxidizer solution makes up between about 94 to 97% of the matrix.

9. A slurry explosive consisting esentially of from about 14% to 40% by weight of a matrix composition comprising an oxidizer solution selected from the group consisting of an aqueous sodium perchlorate solution, an aqueous ammonium perchlorate solution, an aqueous calcium nitrate solution, or a combination thereof, a thickening agent, and a fuel which serves as a dispersing agent for the thickening agent; a mixture of ammonium nitrate and fuel oil; and a cross linker.

10. A slurry explosive according to claim 9, wherein the matrix makes up about 20% of the slurry explosive.

11. A slurry explosive according to claim 9, wherein the sodium perchlorate solution contains about 55% by weight $NaClO_4$ and about 45% $H_2O$.

12. A slurry explosive according to claim 9, wherein the calcium nitrate solution contains about 50% by weight calcium nitrate and about 50% $H_2O$.

13. A slurry explosive according to claim 9, wherein the fuel in the matrix is ethylene glycol.

14. A slurry explosive according to claim 9, wherein the fuel in the matrix is fuel oil.

15. A slurry explosive according to claim 9, wherein the mixture of ammonium nitrate and fuel oil comprises about 94% ammonium nitrate and about 6% fuel oil.

16. A method of making a slurry explosive comprising the steps of preparing a matrix containing an oxidizer solution selected from the group consisting of an aqueous sodium perchlorate solution, an aqueous ammonium perchlorate solution, an aqueous calcium nitrate solution, or a combination thereof, a fuel, and a thickening agent; mixing the matrix with a standard ammonium nitrate-fuel oil dry explosive; and adding a cross-linker to the matrix and ammonium nitrate-fuel oil mixture so that the mixture forms a gel.

17. A method according to claim 16, wherein the step of mixing the matrix with the ammonium nitrate-fuel oil dry explosive includes measuring the respective amounts of materials so that the amount of matrix added to the ammonium nitrate-fuel oil results in the matrix making up between about 14% and 40% by weight of the final slurry explosive.

18. A method according to claim 17, wherein the step of mixing the matrix with the ammonium nitrate-fuel oil dry explosive includes measuring the respective amounts of materials so that the amount of matrix added to the ammonium nitrate-fuel oil results in the matrix making up about 20% by weight of the final slurry explosive.

19. A method of making a slurry explosive comprising the steps of preparing a matrix containing an oxidizer solution selected from the group consisting of an aqueous sodium perchlorate solution, an aqueous ammonium perchlorate solution, an aqueous calcium nitrate solution, or a combination thereof, a fuel, and a thickening agent; and mixing the matrix with a standard ammonium nitrate-fuel oil dry explosive.

20. A method according to claim 19, wherein the step of mixing the matrix with the ammonium nitrate-fuel oil dry explosive includes measuring the respective amounts of materials so that the amount of matrix added to the ammonium nitrate-fuel oil results in the matrix making up between about 14% and 40% by weight of the final slurry explosive.

21. A method according to claim 20, wherein the step of mixing the matrix with the ammonium nitrate-fuel oil dry explosive includes measuring the respective amounts of materials so that the amount of matrix added to the ammonium nitrate-fuel oil results in the matrix making up about 20% by weight of the final slurry explosive.

22. A matrix composition according to claim 1, wherein the water and other ingredient content of the matrix is such as will make the matrix effective, when mixed with standard ammonium nitrate-fuel oil dry explosive in the range of about 20% matrix by weight, to produce a slurry explosive.

23. A matrix composition according to claim 1, wherein the water content of the matrix is between about 42% and 49%.

24. A slurry explosive consisting esentially of from about 14% to 40% of a matrix composition comprising an oxidizer solution selected from the group consisting of an aqueous sodium perchlorate solution, an aqueous ammonium perchlorate solution, an aqueous calcium nitrate solution, or a combination thereof, a thickening agent, and a fuel which serves as a dispersing agent for the thickening agent; and a mixture of ammonium nitrate and fuel oil.

* * * * *